US005896603A

United States Patent [19]

Cooper

[11] Patent Number: 5,896,603

[45] Date of Patent: Apr. 27, 1999

[54] ARTICLES WITH GRIPPING SURFACES

[75] Inventor: Robert W. Cooper, Barrington, R.I.

[73] Assignee: Klear-Vu Corporation, Fall River, Mass.

[21] Appl. No.: 08/993,602

[22] Filed: Dec. 18, 1997

[51] Int. Cl.[6] ..... A47C 27/00

[52] U.S. Cl. ..... 5/653; 5/925; 297/228.11; 108/90

[58] Field of Search ..... 5/411, 653, 654, 5/925; 108/90; 297/219.1, 224, 218.4, 228.11

[56] References Cited

U.S. PATENT DOCUMENTS

| | | | |
|---|---|---|---|
| D. 360,794 | 8/1995 | Morin . | |
| 2,156,629 | 5/1939 | Hutchison | 5/925 X |
| 2,483,223 | 9/1949 | Moss | 297/228.11 |
| 2,546,109 | 3/1951 | Puchalsky . | |
| 3,242,507 | 3/1966 | Peterson | 5/411 X |
| 3,637,454 | 1/1972 | Pavernick | 161/144 |
| 3,829,914 | 8/1974 | Treat | 5/925 X |
| 3,916,447 | 11/1975 | Thompson . | |
| 4,137,356 | 1/1979 | Shoemaker et al. | 428/211 |
| 4,457,032 | 7/1984 | Clarke . | |
| 5,047,267 | 9/1991 | Pantaleo et al. | 428/13 |
| 5,125,121 | 6/1992 | Wroble . | |
| 5,388,295 | 2/1995 | Sarkozi . | |
| 5,429,852 | 7/1995 | Quinn . | |
| 5,465,441 | 11/1995 | Chun . | |
| 5,621,931 | 4/1997 | Hamilton . | |
| 5,634,223 | 6/1997 | Obermaier | 5/925 X |
| 5,809,595 | 9/1998 | Stevens et al. | 5/925 X |

*Primary Examiner*—Michael F. Trettel
*Attorney, Agent, or Firm*—James & Franklin, LLP; Robert L. Epstein, Esq.; Harold James, Esq.

[57] ABSTRACT

Chair cushions and placemats are formed of a top fabric panel attached to a bottom panel with a high coefficient of friction. The bottom panel is a rubberized web with an open mesh pattern. It is formed of parallel, spaced, undulating thread-like members which extend in one direction. First and second sets of parallel, spaced, straight thread-like members respectively extend along lines oppositely inclined relative to that direction. The straight thread-like members intersect with the undulating thread-like members forming enlarged nodes aligned along spaced parallel lines extending in the perpendicular direction.

11 Claims, 3 Drawing Sheets

FIG. 3
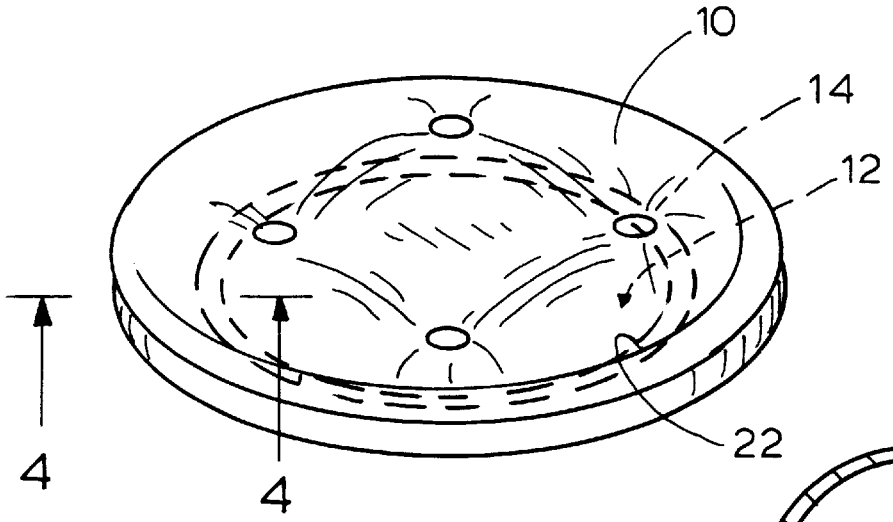
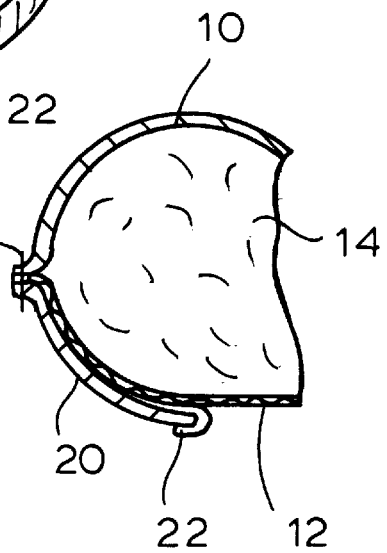
FIG. 4
FIG. 5
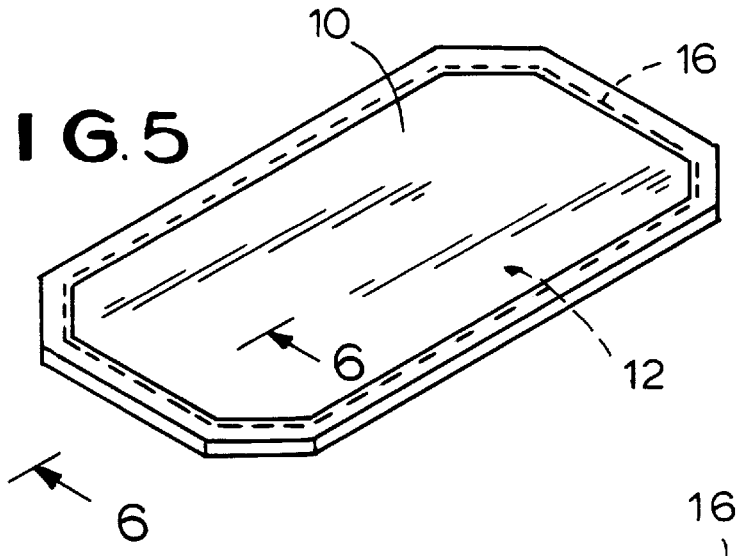
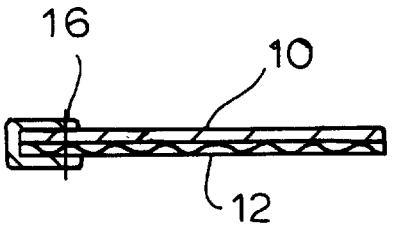
FIG. 6

FIG. 7
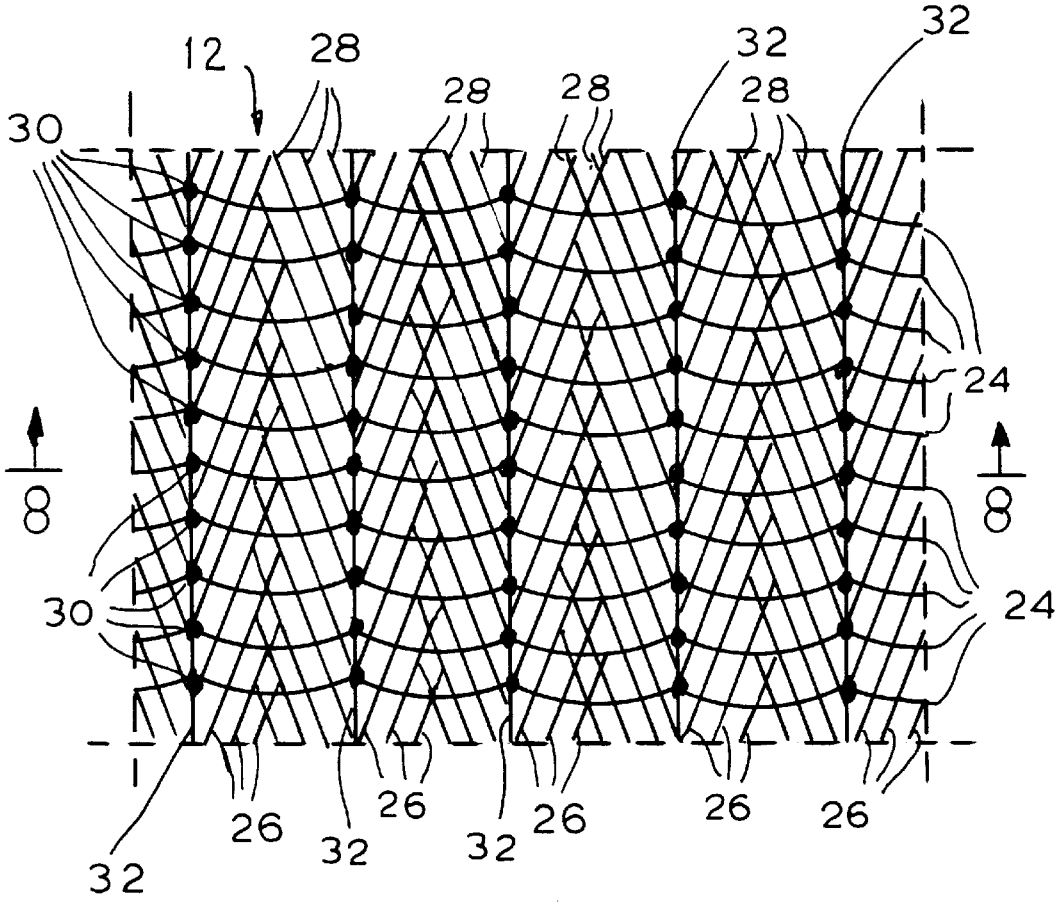
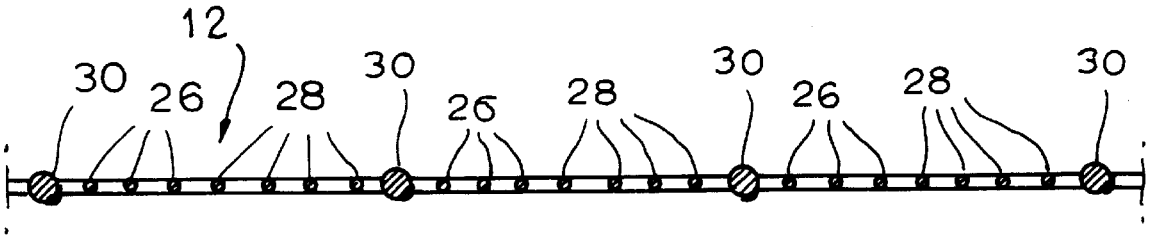
FIG. 8

ARTICLES WITH GRIPPING SURFACES

This invention relates to household articles with gripping surfaces and more particularly to cushions for chairs and stools as well as placemats and more particularly, to such articles which include a top fabric panel and a bottom panel with a high coefficient of friction surface in the form of a rubberized web with an open mesh pattern.

One problem with a variety of household articles is that they are used on surfaces which are smooth and the articles tend to slip relative to the surface. This is particularly true of chair cushions, which tend to slide along the chair seat as they are being sat upon and placemats which may move along a table or counter as plates or other objects are placed on it.

With regard to chair cushions, string ties are conventionally used to anchor the cushion to the chair. For stools with round seats, an inwardly extending elastic rim may be used to overlap the edges of the seat to secure the cushion.

There have been suggestions in the art that a rubber grip material be used in combination with or be made a part of a cushion. For example, the design patent to Morin, Des. 360,794, issued Aug. 1, 1995 shows a combined child cushion and rubber grip pad unit. U.S. Pat. No. 4,457,032 entitled "Seat Cushion" issued to Clarke on Jul. 3, 1984 discloses a cushion having a lower layer which has a high coefficient of friction. U.S. Pat. No. 5,429,852 entitled "Transportable Chair Pad" issued to Quinn on Jul. 4, 1995 shows a tufted seat cushion which includes a bottom vinyl layer with a plurality of aeration holes. The bottom layer has a high coefficient of friction.

Rubberized web material with an open mesh pattern is commercially available in sheet form. It is used for a variety of different applications, including as non-slip padding under rugs and carpets. The sheets have an irregular surface texture which adds to the characteristics of the rubberized material from which it is made to create a very high coefficient of friction surface.

At the same time, the web material has a open mesh design which permits air to pass through readily. It is highly compressible but has sufficient structural integrity to be sewn to fabric without tearing. These features, as well as low price and ease of handling, make this web material ideal for use as a gripping surface for articles such as chair cushions and placemats.

It is, therefore, a prime object of the present invention to provide articles with gripping surfaces which employ high coefficient of friction rubberized web bottom panels with an open mesh pattern.

It is another object of object of the present invention to provide articles with gripping surfaces formed of commercially available rubberized web material which has sufficient structural integrity to be sewn or otherwise affixed to a fabric panel.

It is another object of the present invention to provide articles with gripping surfaces are relatively inexpensive to manufacture using commercially available materials and standard fabrication equipment, but which will function reliably for a long useful life.

In accordance with one aspect of the present invention, a cushion is provided including a top fabric panel and a bottom panel of high coefficient of friction material, having an edge. A layer of resilient material is interposed between the panels. Means attach the top panel and the edge of the bottom panel to enclose the resilient layer. The bottom panel is a rubberized web with an open mesh pattern. The pattern is formed of a plurality of substantially parallel, spaced, undulating thread-like members extending in a first general direction. First and second sets of a substantially parallel, spaced, substantially straight thread-like members extend in directions oppositely inclined relative to the first direction. The substantially straight thread-like members intersect with the undulating thread-like members.

A plurality of enlarged nodes are formed at the intersections of the thread-like members. The nodes are preferrably aligned along a second direction, perpendicular to the first direction. Most preferrably, the nodes align to form a pluraltiy of spaced parallel lines extending in the second direction.

The resilient layer may comprise a foam layer. It may also include any material suitable as fill for a cushion, which may be enclosed in a fabric cover.

The cushion may be designed for use on the seat of a stool. In this case, the top fabric panel extends beyond the attaching means, inwardly along the bottom panel. Elastic means are situated along the edge of the top panel so as to define a recess for receiving the seat of the stool.

The top panel may also include a skirt. The skirt extends outwardly beyond the attaching means.

In accordance with another aspect of the present invention, a placemat is provided comprising a top fabric panel and a bottom panel of high coefficient of friction material, having an edge. Means attach the top panel and the edge of the bottom-panel. The bottom panel is a rubberized web with an open mesh pattern. The pattern is formed of a plurality of substantially parallel, spaced, undulating thread-like members extending in a first general direction. First and second sets of a substantially parallel, spaced, substantially straight thread-like members extend in directions inclined relative to the first direction. The substantially straight thread-like members of intersect with the undulating thread-like members.

To these and to such other objects which may hereinafter appear, the present invention relates to articles with gripping surfaces, as set forth in detail in the following specification and recited in the annexed claims, taken together with the accompanying drawings, wherein like numerals refer to like parts and in which:

FIG. 3 is a perspective view of a third preferred embodiment of the present invention in the form of a generally circular stool cushion;

FIG. 4 is a cross-sectional view taken along line 4—4 of FIG. 3.

FIG. 5 is a perspective view of a fourth preferred embodiment of the present invention in the form of a placemat.

FIG. 6 is a cross-sectional view taken along line 6—6 of FIG. 5;

FIG. 7 is an enlarged fragmentary plan view of a portion of a typical bottom panel showing the structure of the rubberized web;

FIG. 8 is a cross-sectional view taken along line 8—8 of FIG. 7.

Figure 1:
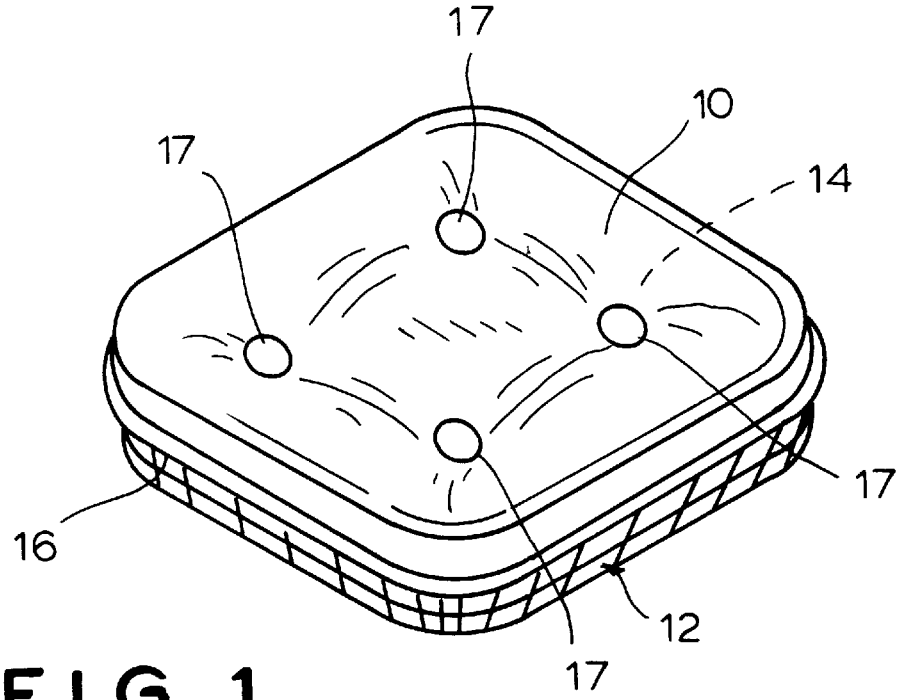
FIG. 1 is a perspective view of a first perferred embodiment of the present invention in the form of a generally recangular tufted chair cushion.
Figure 2:
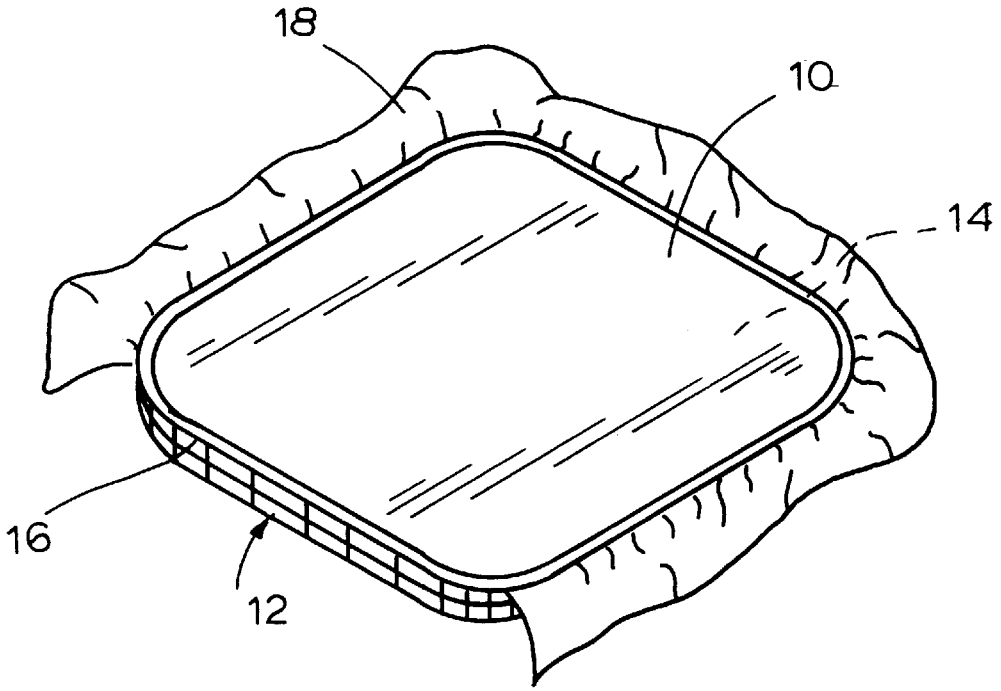
FIG. 2 is a perspective view of a second preferred embodiment of the present invention in the form of a generally rectangular skirted chair cushion.

The invention can be employed in any style of chair cushion. FIG. 1 shows the invention embodied as a tufted chair cushion. FIG. 2 shows the invention embodied as a chair cushion with an outwardly extending skirt. FIG. 3 shows the invention embodied in a stool cushion. In each case, the cushion consists of a top panel 10 composed of any suitable fabric material, including vinyl or plastic, and a bottom panel 12. Bottom panel 12 is composed of a cut to size sheet of commercially available material with a high coefficient of friction and irregular surface texture which prevents the cushion from sliding along the seat of a chair or stool.

Sandwiched between top panel 10 and bottom panel 12 is a layer of resilient material 14. Material 14 may be foam. However, any suitable cushion filler, enclosed in a cover, can be employed. The edge of bottom panel 12 is sewn to top panel 10 by stitches 16, so as to enclose the resilient layer.

In the first embodiment, the panels are additionally sewn together, in a circular pattern, through the resilient layer at spaced locations, to form tufts 17. In the second embodiment, the top panel 10 extends outwardly beyond stitches 16 on three sides to form a skirt 18. In the third embodiment, a third panel 20 extends from stitch line 16 inwardly, along the bottom panel 12, ending in a rim 22. Rim 22 is provided with an elastic strip. In this way, a expandable recess is formed between panel 20 and bottom panel 12 for receiving the seat of a stool.

FIGS. 5 and 6 show a placemat constructed in accordance with the present invention. Like the cushions, it has a fabric top panel 10 and a high coefficient of friction bottom panel 12 sewn together around the periphery by stitches 16. Unlike the cushions, it has no resilient layer situated between the panels.

The structure of the rubberized web can best be seen in FIGS. 7 and 8. It consists of a plurality of substantially parallel, spaced, undulating thread-like members 24 extending in a first general direction (horizontal as seen in the drawing). A first set 26 and a second set 28 of substantially parallel, spaced, straight thread-like members form the remainder of the mesh. The members of first set 26 extend in a direction which is inclined at approximately 45° with respect to the first direction. The members of the second set 28 extend in a direction which is oppositely inclined relative to the first direction, as compared to the members of first set 26.

The members of sets 26 and 28 intersect the members of the undulating members 24, forming a plurality of nodes 30 at the intersections. Nodes 30 align in a second direction, perpendicular to the first direction (vertical as seen in the drawing). They form a plurality of spaced parallel lines 32 extending in the second direction.

Not only does the rubberized web material itself provide a high coefficient of friction, the irregular surface formed by the threads and the nodes, the latter of which are raised above the surface of the threads (see FIG. 8), contribute to the gripping ability of the bottom panel.

The parallel spaced undulating thread-like members 24 create a great amount of friction in a direction perpendicular to the direction in which they extend. Similarly, each set of substantially straight thread-like members 26, 28 creates a high amount of friction in the direction perpendicular to the direction in which it extends. Since the nodes align along spaced parallel lines 32 extending in the direction perpendicular to the direction in which the undulating thread-like members extend, they create a high degree of friction in the direction which the undulating members extend. Consequently, this web material creates a high non-slip surface which will counteract movement in at least eight different directions.

It will now be appreciated the the present invention relates to articles such as chair cushions and placemats with gripping bottom surfaces. The bottom surfaces are formed of a rubberized web with an open pattern which has a high coefficient of friction but permits air to pass freely through it. This commercially available material has sufficient structral integrity to permit it to be sewn to the top panel. It is inexpensive and easy to handle, forming a reliable product with a long useful life.

While only a limited number of preferred embodiments have been disclosed for purposes of illustration, it is obvious that many variations and modifications could be made thereto. It is intended to cover all of these variations and modifications which fall within the scope of the present invention, as set forth in the following claims:

I claim:

1. A cushion comprising a top fabric panel and a bottom panel of high coefficient of friction material having an edge, a layer of resilient material, means for attaching the top panel and said edge of the bottom panel to enclose said resilient layer, said bottom panel comprising a rubberized web with an open mesh pattern formed of a plurality of substantially parallel, spaced, undulating thread-like members extending in a first general direction and first and second sets of a substantially parallel, spaced, substantially straight thread-like members extending in directions oppositely inclined relative to said direction, with the substantially straight thread-like members of each set intersecting said undulating thread-like members.

2. The cushion of claim 1 further comprising a plurality of nodes formed at the intersections of said thread-like members.

3. The cushion of claim 2 wherein said nodes are aligned along a second direction, substantially perpendicular to said direction.

4. The cushion of claim 3 wherein said nodes align to form a plurality of spaced parallel lines extending in said second direction.

5. The cushion of claim 1 wherein said resilient layer comprises a foam layer.

6. The cushion of claim 1 designed for use on the seat of a stool, further comprising a third panel extending inwardly from said attaching means along said bottom panel and elastic means situated along the rim of said third panel, so as to define a recess for receiving the seat of the stool.

7. The cushion of claim 1 wherein said top panel further comprises a skirt which extends outwardly beyond said attaching means.

8. A placemat comprising a top fabric panel and a bottom panel of high coefficient of friction material, having an edge, means for attaching the top panel and said edge of the bottom panel, said bottom panel comprising a rubberized web with an open mesh pattern formed of a plurality of substantially parallel, spaced, undulating thread-like members extending in a first general direction and first and second sets of a substantially parallel, spaced, substantially straight thread-like members extending in directions oppositely inclined relative to said direction, the substantially straight thread-like members of each set intersecting said undulating thead-like members.

9. The placemat of claim 8 further comprising a plurality of nodes formed at the intersections of said thread-like members.

10. The placemat of claim 9 wherein said nodes are aligned along a second direction, substantially perpendicular to said direction.

11. The placemat of claim 10 wherein said nodes align to form a plurality of spaced parallel lines extending in said second direction.

* * * * *